United States Patent [19]

Truscott

[11] Patent Number: 4,819,748

[45] Date of Patent: Apr. 11, 1989

[54] ROOF DRILL BIT

[76] Inventor: Aaron S. Truscott, 202 N. Frontage Rd., Helper, Utah 84526

[21] Appl. No.: 16,879

[22] Filed: Feb. 20, 1987

[51] Int. Cl.[4] ..... F21B 10/58; F21B 10/60

[52] U.S. Cl. ..... 175/410; 175/320; 175/393; 403/377

[58] Field of Search ..... 299/11, 81, 91, 92; 175/393, 401, 410, 415, 320, 65; 285/403, 404; 403/377, 378, 326, 109

[56] References Cited

U.S. PATENT DOCUMENTS

| | | | |
|---|---|---|---|
| 1,961,390 | 6/1934 | Ragsdale | 175/393 |
| 2,226,655 | 12/1940 | Beaven | 255/61 |
| 2,522,045 | 9/1950 | Knowles | 255/64 |
| 2,628,821 | 2/1953 | Alexander et al. | 175/410 X |
| 2,679,382 | 5/1954 | Schmidt | 255/64 |
| 3,048,231 | 8/1962 | Beck | 175/343 |
| 3,434,553 | 3/1969 | Weller | 175/410 |
| 3,807,515 | 4/1974 | Evans | 175/410 |
| 4,026,605 | 5/1977 | Emmerich | 299/92 |
| 4,099,585 | 7/1978 | Emmerich | 175/320 |
| 4,123,848 | 11/1978 | Emmerich et al. | 33/185 R |
| 4,165,790 | 8/1979 | Emmerich | 175/410 |
| 4,175,757 | 11/1979 | Emmerich | 277/212 F |
| 4,190,125 | 2/1980 | Emmerich et al. | 175/410 |
| 4,190,128 | 2/1980 | Emmerich | 175/415 X |
| 4,206,821 | 6/1980 | Emmerich | 175/321 |
| 4,226,290 | 10/1980 | McSweeney | 175/320 |
| 4,299,510 | 11/1981 | Emmerich et al. | 403/282 |
| 4,398,611 | 8/1983 | Sarin | 175/393 X |
| 4,492,278 | 1/1985 | Leighton | 175/410 |
| 4,605,079 | 8/1986 | Leibee et al. | 175/410 |

FOREIGN PATENT DOCUMENTS

| | | | |
|---|---|---|---|
| 74114 | 9/1953 | Netherlands | 175/418 |

OTHER PUBLICATIONS

VR/Wesson Mining & Construction Tools, "Mining Tools" (U.S.A., 1984).

*Primary Examiner*—Jerome W. Massie IV
*Assistant Examiner*—David J. Bagnell
*Attorney, Agent, or Firm*—Workman, Nydegger & Jensen

[57] ABSTRACT

A mining drill bit for attachment to a hollow drill steel is provided with water openings in the head thereof on either side of a planar cutting member in close proximity to the leading edges thereof. Preferably the water openings are in addition radially and axially proximate to the chisel edge of the cutting member. Water injected into the end of a bore hole through the water openings efficiently removes drillings from the vicinity of the cutting member. Two planar slurry surfaces formed on diametrically opposite sides of drill bit head and truncating the circumference of the head at the base thereof so as to form chordal lips funnel water injected into the end of the bore hole and cuttings removed from the vicinity of the cutting member away from the end of the bore hole for removal therefrom in two localized columns of high velocity flow that scour accumulations of cuttings from the walls of the bore hole. The cutting member is supported across the full diameter of the drill bit head by triangular support shoulders which are thicker at the trailing edge of the cutting member than at the leading edge thereof.

42 Claims, 2 Drawing Sheets

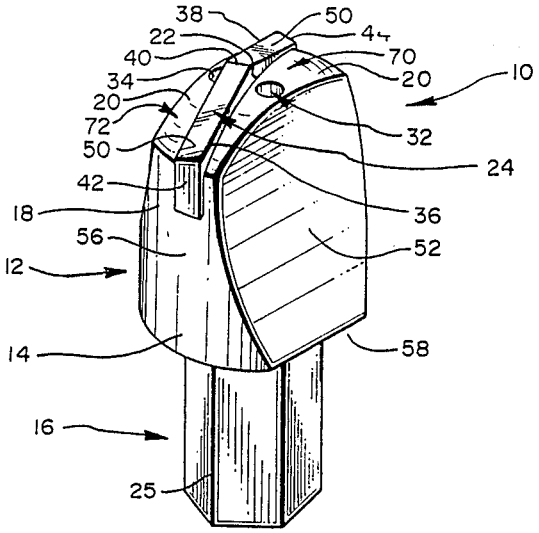
FIG. 1
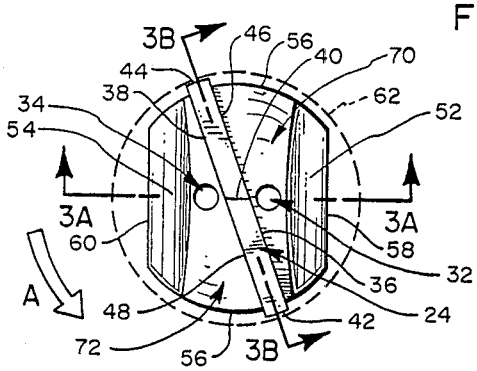
FIG. 2
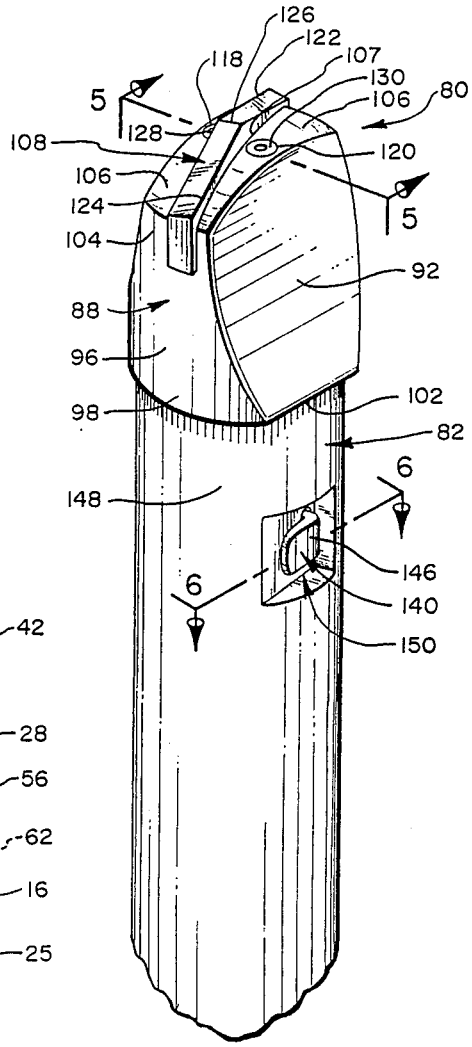
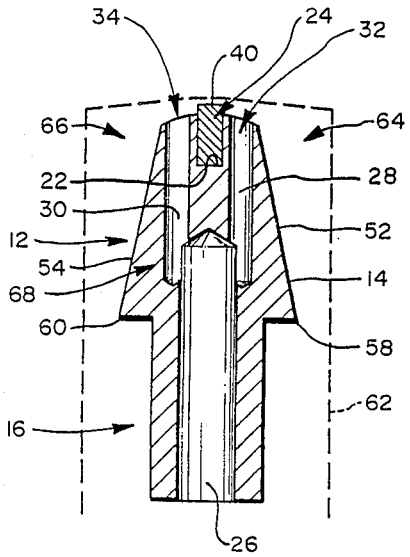
FIG. 3A
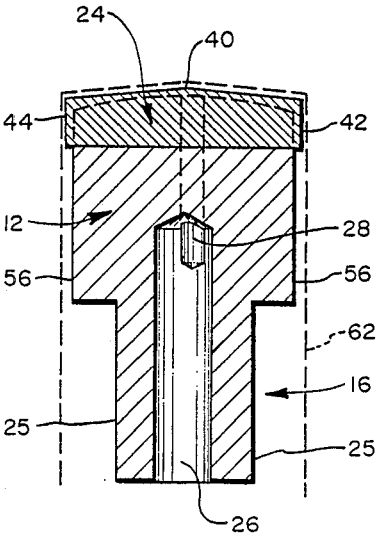
FIG. 3B
FIG. 4

ROOF DRILL BIT

BACKGROUND OF THE INVENTION

1. Field of the Invention

This invention relates to drill bits for cutting bore holes in rock or concrete, and more particularly to roof drill bits employed in mining for cutting bore holes in an unsupported mine ceiling so as to permit the securing therein of safety roofing.

2. Background Art

In the field of natural mineral resource extraction, pressure continues unabated for rapid development to meet increasing resource demands and to reduce dependency on imported resources. On the other hand, widespread support exists for the preservation of environmental quality and the protection of the safety of extraction industry workers during the process. These imperatives are nowhere more apparent than in the mining industry.

While mining has in recent years become increasingly automated, speeding resource development and extraction and, to an extent, increasing worker safety, several essential activities in mining have been substantially unaffected by this modernization. In many instances, specific undertakings required of mine workers to advance mine operations have not improved in efficiency and continue to expose workers to substantial risks.

For example, much drilling associated with mining continues to require the immediate presence of mine workers Drilling in any environment is hazardous to a degree, as it involves the use of high speed machinery, the potential for flying debris, and the risk of dust inhalation and noise-induced hearing damage. In addition, however, drilling in mining frequently is required at the sites of the physical expansion of a mine facility. These are dangerous areas, often remote from routes to the surface, where adequate ventilation, structural support, communication facilities, and rescue access means have yet to be installed.

In established areas of a mine, the ceilings are generally roofed over to preclude rock and debris from falling to the floor, injuring workers, or causing hazardous clutter. Such roofing is supported from the mine ceiling itself on rods or bolts which are embedded in a resin in a matrix of vertically oriented bore holes. The bore holes, which extend from two to twenty or more feet (0.61 to 6.1 meters) into the rock of the mine ceiling, must be drilled by using conventional drilling machinery at a point in time when no overhead protection whatsoever can be provided to the drill operator. Only after an entire suitable matrix of bore holes has been created and each filled with appropriate bonding resin to implant rods or bolts therein, can panels of the roofing begin to be mounted on the exposed rod or bolt ends and safety improved. Before this, all workers, and particularly roof drill operators, are exposed to the obvious and grave dangers associated with mine cave-ins. Accordingly, every possible effort is made so that time spent under such conditions is minimized.

In relation to the drilling required to erect roofing, reducing the amount of time it takes to cut each bore hole can contribute to safety by diminishing the time that a drill operator is required to labor beneath an unsupported ceiling of rock. To do so would require increased cutting speed in the tools used which is not without its own difficulties, as will be explained below.

A second way in which the exposure of mining personnel to the risk of unsupported mine ceilings could be diminished would be to reduce the frequency with which cutting tools malfunction. Each breakdown necessitates time spent attending to the drilling tool itself. During these times, mine workers continue to labor under unsafe conditions, and no progress whatsoever occurs in drilling the bore holes themselves. Drilling tools which break down frequently or which are complicated to repair or replace only expose the unlucky operator to longer periods of risk, uncertainty, and possible injury.

In addition, once an adequate matrix of roof support bore holes has been drilled, it is important that the resin used to hold the roofing support rods or bolts will securely adhere to the sides of the bore holes. Where the drilling techniques employed to produce the bore holes result in bore hole walls that bear an accumulation of drilling cuttings, reliable resin bonding is unpredictable. Unclean bore holes, thus exacerbate the dangers involved in opening new areas of a mine by giving rise to the possibility that alternate bore holes may need to be drilled, or worse, that installed roofing may give way.

In reducing the frequency and severity of mechanical failures in roof drills and in improving the cleanness of completed bore holes, it is critical to focus on the drill bit employed. During use, the drill bit is forced against the end of the bore hole and rotated at high speed in a confined area. These conditions give rise to high temperatures and severe mechanical stresses in the drill bit. Efforts to speed drilling by running machinery faster will ultimately prove counterproductive if by increasing the heat and stress to which the drill bit is exposed, higher rates of failure and increased down time result.

The cuttings dislodged from the end of a bore hole by the cutting member of a drill bit must be removed from the bore hole, if drilling is to progress and if equipment failure is to be avoided. Clearing cuttings from the bore hole permits the drill bit to be advanced so as to continue to cut out new rock. Once removed from the end of the bore hole, cuttings must thereafter eventually exit the bore hole entirely Behind the drill bit, substantially filling the cross-section of the bore hole, are substantially cylindrical, usually hollow shaft-like drill steels with which the drill bit is driven. If cuttings are not removed, constriction and friction in the mechanical assembly will intensify, a problem that is exacerbated by the known tendency of mining cuttings to expand upon being dislodged. This is due to the fact that the rock from which the cuttings are dislodged has itself long been in a state of compression arising from the weight of overlying strata of rock and the mechanical geological activity in the earth.

In addition, unless cuttings are effectively and promptly removed from the vicinity of the rotating drill bit and eventually from the bore hole itself, conditions of heat and temperature can develop in which drillings will fuse together on the drill bit and other parts of the assembly, as well as against walls of the bore hole. The latter reduces the effective size of any resulting bore hole and contributes to a bore hole which does not bond well with the resin inserted to hold roof support rods.

One approach to removing cuttings from the end of a bore hole has been to use air suction to draw the cuttings out of the end of the bore hole through passageways in the drill bit that communicate with the interior of the associated drill steels. This process, however, produces an unhealthy high level of dust in the air in a mine, and has begun to be viewed with disfavor.

Alternatively, in order to both cool the drill bit and attempt to wash cuttings from the end of the bore hole, water has been introduced into the end of the bore hole through the interiors of drill the steels and various patterns of communicating passageways formed in the drill bit. Such efforts, however, have not to date been entirely satisfactory due to the failure to discover a combination of passageway positioning and drill bit shape that will reliably and rapidly remove cuttings and water from the end of the bore hole. Frequently, cuttings still accumulate on the drilling assembly or the walls of the bore hole.

A particular problem is encountered when the bore hole passes through softer stratas of rock, sand, or clay. These substances are also under great pressure. Being somewhat plastic in comparison with other rock, they will frequently flow out of the space in which they are confined and into a bore hole when that space is penetrated by an advancing drill bit. This sudden flood of material can overwhelm the capacity of a cuttings extraction system. Temperature and pressure will build, and localized regions of the bore hole will dry up, fusing cuttings and causing fluid outflow to become constricted and channeled into localized areas around the bore hole wall, if not cut off totally.

The water required to remove cuttings in such systems raises additional difficulties. A mine is an environment in which the volume of space is relatively limited. Water used in a mine for any purpose can become a problem if its volume is substantial. In light of environmental regulations, it is desirable not to bring water used for the purpose of flushing cuttings from bore holes to the surface after its use. Therefore, the water utilized to cool and flush such drilling operations should be of as small a volume as possible so as to permit its storage and processing underground in the mine itself. Slowly cutting drills will draw flush water for longer periods of time, suggesting an additional advantage to fast bore hole drilling. Nevertheless, fast drilling results in greater heat and a more rapid generation of cuttings. This in turn may require a more voluminous flow of water. Where water for this purpose cannot be located underground within a mine, it must be introduced into the mine from outside, presenting an additional difficulty for the mining engineer.

Therefore, it can be seen that the need remains unfulfilled for the development of a drill bit of maximum durability which will cut rock at the fastest rate possible and which will withstand the temperature and mechanical stresses associated with the environment in which it is used. The durability of such a drill bit head can be enhanced through the design of an optimal water flow system for removing cuttings from the end of the bore hole and cooling the drill bit itself.

A drill bit for use under such circumstances would be further desirable if designed in such a fashion as to enable its rapid and easy replacement if and when it should malfunction. Also, a drill bit head that reliably produces bore holes with clean and readily bondable walls would further reduce the need for redrilling and shorten the exposure of workers to dangerous conditions.

Until the development of the present invention, however, a drill bit meeting these requirements of the modern mining industry was not available.

SUMMARY OF THE INVENTION

One object of the present is to produce a drill bit capable of rapidly cutting bore holes, while at the same time being possessed of an extended operating life time due to sturdy design.

A further object of the present invention is to produce a drill bit that contributes to a consistently efficient removal of cuttings from the end of the bore hole in which it is used.

Another object of the invention is to control the volume of water required to enable the effective drilling of roofing support bore holes in unsupported mine ceilings.

Still another object of the invention is to simplify and speed the process of drill bit replacement in such instances that a drill bit does fail.

Yet another object of the present invention is to create a drill bit which cuts bore holes having consistently clean walls, thereby permitting the bonding of roofing support rods or bolts therein with increased reliability.

All these objects taken cumulatively have the purpose of enhancing the speed with which new mineral resources can be developed and extracted, while preserving or enhancing the safety of mining workers and the quality of the environment.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims.

To achieve the foregoing objects, and in accordance with the invention as embodied and broadly described herein, a mining drill bit for attachment to a hollow drill steel to rotate therewith and to cut a bore hole in rock or concrete is provided in one embodiment of the invention comprising a shank insertable in a socket in one end of the drill steel and a drill bit head having a distal end and a base at the end opposite therefrom. The drill bit head is rigidly attached at its base to the shank in axial alignment therewith, and a generally planar cutting member is retained in the distal end of the drill bit head in alignment with the longitudinal axis thereof for bearing against the end of the bore hole during drilling to dislodge cuttings.

Irrigation means are provided for injecting water into the end of the bore hole during drilling so as to remove cuttings from the vicinity of the cutting member. Preferably, the irrigation means comprises a primary water conduit axially formed through the shank and opening on the interior of the drill steel and two secondary water conduits formed in the drill bit head, each of which communicates at one end thereof with the primary water conduit and terminates at the other end thereof in distinct water openings in the distal end of the drill bit head. The water openings are located on opposite sides of the cutting member in close proximity to a leading edge thereof, and are further preferably located both radially and axially proximate to the chisel edge of the cutting member.

The combined cross-sectional areas of the two water openings is preferably substantially less than the cross-sectional area of the bore hole minus the largest cross-sectional area of the drill bit head taken in a plane normal the longitudinal axis thereof. Optionally, cylindrical sleeves may be provided for pressing into the water openings to reduce the effective cross-sectional areas thereof.

In another preferred embodiment of the present invention, a mining drill bit as previously described may further be provided with slurry means for scouring cuttings from the wall of the bore hole adjacent the drill bit head and for removing cuttings from the end of the bore hole. Preferably, the slurry means comprises two planar slurry surfaces formed in diametrically opposite sides of the drill bit head on opposite sides of the plane of the cutting member. The slurry surfaces are inclined relative to the longitudinal axis of the drill bit head so as to be more remote radially from the axis of the drill bit head at its base than at its distal end. The slurry surfaces intersect and truncate the circumference of the base of the drill bit head at chordal lips past which each of the slurry surfaces, and the wall of the bore hole opposite respectively thereto, funnel water injected into the end of the bore hole and cuttings removed from the vicinity of the cutting member.

In another preferred embodiment of the present invention, a mining drill bit is provided comprising a shank, a generally cylindrical drill bit head, two planar slurry surfaces formed on diametrically opposite sides of the drill bit head defining therebetween at a distal end of the drill bit head a diametrically disposed wedge-shaped lead portion, and a diametrical slot in the lead portion adapted to receive and to retain in alignment with the longitudinal axis of the drill bit head a generally planar cutting member The shank is advantageously hexagonal in cross-section and the plane of the diametrical slot is aligned with diametrically opposite vertices thereof. The diametrical slot preferably separates the lead portion of the drill bit head into two upstanding generally triangular cutting member support shoulders that extend between diametrically opposite sides of the drill bit head. The cutting member support shoulders support opposite faces of the cutting member transverse the diameter of the drill bit head when the cutting member is received in the diametrical slot. The thickness of each support shoulder measured normal the face of the cutting member adjacent thereto is less adjacent the leading edge side of the face of the cutting member than adjacent the trailing edge side thereof.

In yet another preferred embodiment of the present invention, in a mining drill bit as described above, the shank and the drill steel are each provided with a radially disposed retention passageway. The retention passageway in the shank communicates through the shank with the primary water conduit, and the retention passageway in the drill steel communicates through the drill steel to the socket thereof which receives the shank. The two retention passageways are alignable one with another by inserting the shank into the socket of the drill steel. A selectively removable retention pin is provided having a resilient arcuate tip for insertion through the retention passageways when aligned. Under such circumstances, the arcuate tip resides within the primary water conduit out of alignment with the retention passageways, thereby securing the retention pin in the retention passageways and retaining the shank of the drill bit in the drill steel.

BRIEF DESCRIPTION OF THE DRAWINGS

In order that a clearer understanding can be obtained of the manner in which the advantages and objects of the invention arise, a more particular description of the invention briefly summarized above will be provided by reference to the specific embodiments thereof that are illustrated herein in the appended drawings. It is to be understood, however, that these drawings depict only typical embodiments of the invention and therefore are not to be considered limiting of its scope, as the invention may admit of other equally effective embodiments.

The invention will thus be described with additional specificity and detail through the use of the following accompanying drawings:

FIG. 1 is a perspective view of one embodiment of a drill bit incorporating teachings of the present invention;

FIG. 2 is a top plan view of the drill bit of FIG. 1;

FIG. 3A is a cross-sectional elevation view of the drill bit of FIGS. 1 and 2 taken along section line 3A—3A appearing in FIG. 2;

FIG. 3B is a cross-sectional elevation view of the drill bit shown in FIGS. 1 and 2 taken along section line 3B—3B appearing in FIG. 2;

FIG. 4 is a perspective view of a second embodiment of a drill bit incorporating teachings of the present invention and secured to a drill steel;

DESCRIPTION OF THE PREFERRED EMBODIMENTS

Overview

Figure 5:
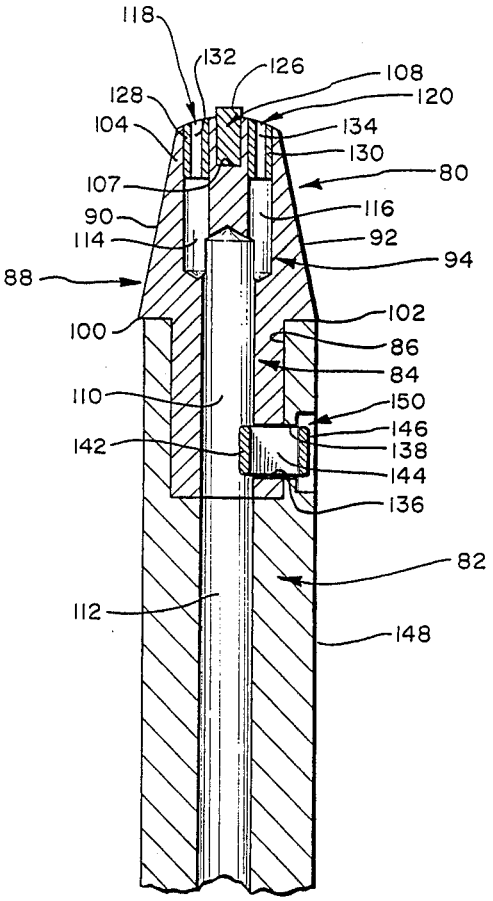
FIG. 5 is a cross-sectional elevation view of the drill bit and drill steel shown in FIG. 4 taken along section line 5—5 appearing therein.

The invention involves a steel drill bit head which is insertable nonrotationally in a socket in the hollow end of a drill steel. Retained in the end of the drill bit head opposite the drill steel is a planar cutting member aligned with the longitudinal axis of the drill bit head.

Water openings communicating with the interior of the drill steel are located in the drill bit head so as to precede the leading edges of the cutting member when the drill bit head rotates. Due to the location of the water openings, water injected through them into the end of the bore hole immediately catches cuttings being dislodged and removes them from the vicinity of the cutting member. In addition, the surface of the drill bit head in which the water openings are formed is at a level close to that of the top of the cutting member and thus to the end of the bore hole This leaves little space between the drill bit head and the end of the bore hole in which cuttings and water from the water openings can pool, increasing the rate of flow of water and cuttings in that space away from the vicinity of the cutting member.

Diametrically opposite sides of the full length drill bit head on opposite sides of the plane of the cutting member are constricted by planar slurry surfaces. These slurry surfaces are inclined in relation to the longitudinal axis of the drill bit head so as to narrow the drill bit head less at its base than at the end in which the cutting member is retained. The slurry surfaces accordingly, in cooperation with the bore hole walls opposite thereto, result in slurry regions which receive water and cuttings flowing across the surface of the drill bit head in which the water openings are formed and direct this flow into two longitudinally disposed columns of fast-moving, high-volume fluid down the sides of the bore hole. These columns of flow, by rotating with the head, serve to keep the bore hole walls clean of cuttings.

The inclination of the slurry surfaces, in relation to the longitudinal axis of the drill bit head, forms of the drill bit head between the slurry surfaces a wedge-shaped lead portion. The cutting member is retained in a diametrical slot at the tip of the lead portion and separates such lead portion into two upstanding triangular cutting member support shoulders. These back the cutting member across the entire diameter of the drill bit head, providing it support on both of its faces and maximizing the surface area that may be utilized to braze the cutting member into the drill bit head. Where the support shoulders follow the cutting member in rotation they are thicker than where they lead the cutting member. This concentrates support for the cutting member behind the portions thereof that are actually dislodging cuttings and reduces the lateral distance ahead of those same portions over which new cuttings must travel before passing over the edge of the lead section and down the slurry surfaces.

Specific embodiments of the inventive drill bit will be described in additional detail in the following section.

DETAILED DESCRIPTION

Referring to FIGS. 1 and 2, together, one embodiment 10 of a mining drill bit according to the teachings of the present invention is shown to comprise a drill bit head 12 rigidly attached at the base 14 thereof to a shank 16 in axial alignment therewith. Shank 16 is non-rotationally insertable in a socket in one end of a hollow drill steel, whereby drill bit 10 may be driven in rotation therewith to cut a bore hole. Although a shank adequate for use with the drill bit of the present invention could be formed into a number of operably adequate cross-sections, such as squares or ovals, a hexagonal cross-section is considered preferable from the point of view of the resulting strength, both of the shank itself and the drill steel in which a correspondingly shaped socket must be formed. Accordingly, shank 16 is depicted in FIG. 1 as having a hexagonal cross-section.

Distal end 18 of drill bit head 12 terminates in a lead surface 20 which is disposed generally normal the longitudinal axis of drill bit head 12. Lead surface 20 may be of planar, conical, or other configuration. A diametrical slot 22, adapted to receive and retain therein a generally planar cutting member 24 in alignment with the longitudinal axis of drill bit 10, is formed in lead surface 20. For enhanced strength in the overall structure of drill bit 10, the plane of cutting member 22 and slot 22 in which it is retained may be aligned with diametrically opposite vertices 25 of the hexagonal cross-section of shank 16, as shown in FIGS. 1 and 3B.

Drill bit head 12 and shank 16 can be made of a hardened steel, such as AISI 4140 and H-13 tool steels or 440 C stainless steel. These materials are capable through induction heat treatment of being tempered to a hardness of 56–60 on the Rockwell "C" hardness scale. Thereafter, the process of brazing a cutting member, such as cutting member 24, into the drill bit head results in further tempering and a hardness of approximately 42 on the Rockwell "C" scale. The shape of drill bit 10 can be produced using either manual production lathes and milling machines, numerical control machines using three or four axes, forging with second operation machinery, or investment casting.

The retention of cutting member 24 in slot 22 is effected by braising using any suitable silver base or similar alloy that melts at a temperature appropriate to creating the desired ultimate tempered hardness in the drill bit itself Ideally, the bonding between cutting member 24 and drill bit head 12 effected by the braisement should be in the range of 80,000 to 120,000 sheer pounds per square inch.

Cutting member 24 can be chosen from various grades of tungsten carbide steel according to the hardness of the rock strata in which the drill bit of the present invention is used. Suitable grades of steel for this purpose include Nos. 306 and 606 tungsten carbide steel as manufactured by Tungsten Carbide Manufacturing. The former grade has an average grain size of three microns, a hardness of 90.1 on the Rockwell "A" scale, and a density of 14.93 grains/cm$^3$. The latter has an average grain size of 6 microns, a hardness of 88.6 on the Rockwell "A" scale, and a density of 14.92 grains/cm$^3$. Both contain six percent cobalt.

In accordance with one aspect of the present invention, irrigation means are provided for injecting water into the end of a bore hole during drilling to remove cuttings from the vicinity of a cutting member, such as cutting member 24. By way of example and not limitation, as best seen in FIG. 3A, such an irrigation means comprises a primary water conduit 26 axially formed through shank 16 so as to open on the interior of a hollow drill steel in which shank 16 is inserted. Also formed in drill bit 10 are secondary water conduits 28, 30 which communicate at one end thereof with primary water conduit 26. The opposite ends of secondary water conduits 28, 30 terminate respectively in water openings 32, 34 in distal end 18 of drill bit head 12 on opposite sides of cutting member 24. Water introduced under pressure into the interior of a drill steel to which drill bit head 10 is attached will according pass through primary water conduit 26, secondary water conduits 28, 30, and water openings 32, 34 in order to enter the end of a bore hole during drilling and remove cuttings from the vicinity of cutting member 24.

To effect correct flow, the combined cross-sectional areas of water openings 32, 34 should be substantially less than the cross-sectional area of the bore hole cut by drill bit 10 minus the largest cross-sectional area of drill bit head 12 taken in a plane normal the longitudinal axis thereof. This affords ample opportunity for the outflow of fluid and cuttings generated by the drilling, preventing the development of back pressure which might retard the removal of cuttings from the end of the bore hole in a prompt manner.

The correct placement of water openings 32, 34 is critical to the successful functioning of the irrigation means of the present invention. In relation to the rotation of drill bit 10 in the direction of arrow A shown in FIG. 2, cutting member 24 can be understood to have two leading edges 36, 38 located on opposite sides of the plane of cutting member 24 between chisel edge 40 thereof and outermost ends 42, 44, respectively. The side of the face of cutting member 24 corresponding to each lead edge will be termed herein as a lead edge side. The remaining edge of each face of cutting member 24 will be termed herein a trailing edge, and the side of the face of cutting member 24 corresponding thereto will be termed a trailing edge side. Thus, trailing edge 46 with leading edge 36 are located on one face of cutting member 24, while trailing edge 48 and leading edge 38 occupy the other.

Water openings 32, 34 should be located in the distal end 18 of drill bit head 12 in close proximity to leading edges 36, 38, respectively, of cutting member 24. When drill bit 10 rotates in the direction shown by arrow A in FIG. 2, water opening 32 will thus precede leading edge 36, while water opening 34 will precede leading edge 38. In this manner, water introduced under pressure into the interior of the drill steel to which drill bit 10 is mounted will be directed against the end of the bore hole being drilled in close proximity to leading edges 36, 38 of cutting member 24.

This arrangement has been discovered to be particularly efficacious for the purpose of removing cuttings from the vicinity of cutting member 24. The exact mechanism by which this occurs is not currently entirely ascertainable, but it is presently believed that in dislodging cuttings from the end of a bore hole, a cutting member, such as cutting member 24, will impart to the cuttings an initial momentum which corresponds to the direction of rotation of the drill bit head. Under such a model, dislodged drillings are thus first projected forward of the leading edge of the cutting member. Locating water openings, such as water openings 32, 34, in a leading relationship to the leading edges of a cutting member results in the immediate capture of newly dislodged cuttings in water introduced into the end of the bore hole, efficiently drawing the cuttings away from the cutting member in the direction of flow created in that water by other aspects of the geometry of a drill bit head, such as drill bit head 12, to be discussed below.

It is considered further advantageous to locate water openings, such as water openings 32, 34, along each corresponding leading edge side of cutting member 24 in a position which is radially proximate to chisel edge 40, as is illustrated in FIG. 2. Other arrangements of water openings 32, 34 along corresponding lead edges 36, 38 are, however, considered to be within the scope of the present invention.

The efficient removal of drillings from the vicinity of cutting member 24 by water introduced into the end of the bore hole through water openings can be further enhanced if water openings, such as water openings 32, 34, are located axially proximate chisel edge 40 of cutting member 24. This can generally be achieved where the top surface 50 of cutting member 24 is only slightly above lead surface 20 of distal end 18 of drill bit head 12. Optimally, a height differential between top surface 50 and lead surface 20 immediately adjacent thereto of 0.100 inches (0.254 cm) is preferred. The positioning of water openings 32, 34 axially proximate to chisel edge 40 in this manner is believed to enhance the removal of cuttings from the vicinity of cutting member 24 by constraining into a narrow area of flow the water emerging from those water openings. In this manner, water from water openings 32, 34 is forced to move rapidly away from leading edges 36,38 of cutting member 24 in a narrow space between lead surface 20 and the end of the bore hole against which top surface 50 of cutting member 24 is rotating. This pattern of water flow carries with it cuttings just dislodged by leading edges 36, 38 of cutting member 24.

In accordance with another aspect of the present invention which cooperates with the irrigation means described above, there is provided a slurry means for scouring cuttings from the walls of a bore hole adjacent the drill bit head and for removing cuttings from the end of the bore hole. By way of example, there are shown in FIGS. 1, 2, and 3A two planar slurry surfaces 52, 54 formed in diametrically opposite sides of drill bit head 12 on opposite sides of the plane of cutting member 24. It should be understood that slurry surfaces 52, 54 need not be absolutely planar in any strictly geometrical sense. All or portions of slurry surfaces 52, 54 may be concave or convex in varying degrees, or even discontinuous, without detracting from the inventive concept which they illustrate, and to which the term planar slurry surfaces will be used to refer herein.

Slurry surfaces 52, 54 are inclined relative the longitudinal axis of drill bit 10 so as to be more remote radially from the longitudinal axis of drill bit head 12 at base 14 than at distal end 18. Further, slurry surfaces 52, 54 intersect and truncate the circumferential periphery 56 of drill bit head 12 at base 14 thereof to form chordal lips 58, 60, respectively. Referring in particular to FIGS. 2 and 3A, wherein the boundary 62 of a bore hole cut by drill bit 10 is shown in broken lines, the orientation of slurry surfaces 52, 54 can be seen to result in longitudinally disposed slurry regions 64, 66, respectively, in which the periphery of drill bit head 12 is axially constricted. While slurry regions 64, 66 extend from distal end 18 to base 14 of drill bit head 12, the lateral cross-section of slurry regions 64, 66 diminishes from distal end 18 to base 14.

When a drill bit head having slurry surfaces, such as slurry surfaces 52, 54, is operated in a bore hole, water injected into the end of the bore hole through water openings 32, 34 and cuttings removed from the vicinity of cutting member 24 encounter less resistance in flowing away from the end of the bore hole at slurry regions 64, 66 than at other points about the circumferential periphery 56 of drill bit head 12. This can readily be appreciated by comparing the space available for the outward flow of water and cuttings between drill bit head 12 in FIG. 2 at slurry surfaces 52, 54 versus that at the non-truncated portions of circumferential periphery 56. A similar understanding of the relative ease of fluid flow in slurry regions 64, 66 can be derived by comparing FIGS. 3A and 3B. Accordingly, water and cuttings tend to flow in heavier quantities and at faster velocities into slurry regions 64 and 66 than down the circumferential periphery 56 of drill bit head 12.

The inclined disposition of slurry surfaces 52, 54 which results in the cross-sectional diminishment of slurry regions 64, 66 from distal end 18 to base 14 creates a funnel-like region between slurry surfaces 52, 54 and the walls of the bore hole 62. This funnel-like region concentrates water injected into the end of the bore hole and cuttings removed from the vicinity of cutting member 24 into a rapidly moving column of suspended solids which rush longitudinally past chordal lips 58, 60 down the sides of bore hole 62. This rapid localized flow of fluid serves to scour from the walls of the bore hole 62 opposite chordal lips 58, 60 all cuttings that might accumulate there. Furthermore, as drill bit head 12 is at the same time continually being rotated, the two columns of rapidly moving longitudinal fluid flow that are created at chordal lips 58, 60 rotate with drill bit head 12 scouring cuttings from all circumferential locations on the walls of bore hole 62 and producing a clean bore hole to which the bonding of resin is enhanced.

Since the outflow of fluid and cuttings is concentrated at two diametrically opposed regions, and since those regions rotate with drill bit head 12, no localized dry areas of cuttings up can begin to build up the walls of bore hole 62 when a drill bit according to the present invention is employed. Instead, cuttings and fluid are continuously and rapidly removed over the top of lead surface 20 from the vicinity of cutting member 24 to flow laterally out of the end of bore hole down slurry surfaces 52, 54 and along the outside of the drill steels in which drill bit 10 is inserted The location of slurry surfaces 52, 54 and corresponding slurry regions 64, 66, respectively, on either side of cutting member 24 below water openings 32, 34, respectively, combines to readily remove cuttings from the vicinity of cutting member 24 and draw them away from the end of the bore hole and drill bit 10 promptly and efficiently. This flow arrangement is highly advantageous both for cooling the drill bit head and for clearing the end of the bore hole from congesting cuttings.

Another feature of the present invention will be noted. Planar slurry surfaces 52, 54 define therebetween at the distal end 18 of drill bit head 12 a diametrically disposed wedge-shaped lead portion 68, which is most readily appreciated as such in FIG. 3A. Slot 22 diametrically disposed in distal end 18 of drill bit head 12 intersects the circumferential periphery 56 of lead portion 68 between slurry surfaces 52, 54 and thus separates lead portion 68 into two upstanding generally triangular cutting member support shoulders 70, 72 which extend between diametrically opposite sides of circumferential periphery 56.

Support shoulders 70, 72 each abut opposite faces of cutting member 24 transverse the entire diameter of drill bit head 12 when cutting member 24 is received in slot 22. This feature enhances the support for cutting member 24 afforded by drill bit head 12 reducing the likelihood of breakage of cutting member 24 due to shock, abrupt changes in strata hardness, or other stresses. In addition, the described structure of support shoulders 70, 72 maximizes the brazing surface available with which to secure cutting member 24 in drill bit head 12. This reduces the likelihood of cutting member 24 being dislodged during use. Both factors contribute to a drill bit having a longer life and fewer failures.

The thickness of each of support shoulders 70, 72 measured normal the face of cutting member 24 is less adjacent the leading edge side of the face of cutting member 24 than it is adjacent the trailing side edge thereof. Thus, with reference to support shoulder 70, for example, the thickness thereof measured normal the adjacent face of cutting member 24 is less adjacent leading edge 36 thereof than at trailing edge 46 thereof. In the embodiment shown in FIG. 1, the thickness of support shoulder 70 is generally a linear function of the distance along cutting member 24 from outermost end 42 to outermost end 44, while the thickness of support shoulder 72 is generally a linear function of the distance along cutting member 24 from outermost end 44 to outermost end 42.

The advantage perceived to this arrangement of slot 22 is that the thicker portions of support shoulders 70, 72 by backing trailing edges 46, 48 respectively, of cutting member 24 offer enhanced support to cutting member 24 behind the portions thereof that are encountering the greatest resistance and mechanical stress during drilling. On the other hand, the thinner portions of support shoulders 70, 72 located in a leading relationship to leading edges 36, 38, respectively, of cutting member 24 permit cuttings dislodged from the end of bore hole 62 to escape laterally from the vicinity of cutting member 24 and exit down slurry surfaces 52, 54, respectively, more quickly than if support shoulders 70, 72 were of greater expanse in that area. Thus, the triangular configuration of support shoulders 70, 72 protects cutting member 24 from fracture while at the same time facilitating the removal of cuttings from its vicinity.

A second embodiment of a drill bit 80 incorporating the teachings of the present invention is shown in FIGS. 4 and 5 mounted in one end of a drill steel 82 to be driven in rotation thereby. As seen in FIG. 5, drill bit 80 includes a shank 84 which is inserted into a socket 86 in the end of drill steel 82 in order to mount drill bit 80. As in drill bit 10 of FIG. 1, drill bit 80 includes a drill bit head 88 rigidly attached to shank 84 in axial alignment therewith. Although drill bit head 88 is generally cylindrical, two planar slurry surfaces 90, 92 formed on diametrically opposite sides of drill bit head 88 define a diametrically disposed wedge-shaped lead portion 94 shown to best advantage in FIG. 5.

Slurry surfaces 90, 92 intersect and truncate the circumferential periphery 96 of drill bit head 88 at the base 98 thereof to form chordal lips 100, 102, respectively. The distal end 104 of drill bit head 88 terminates in a lead surface 106 disposed generally normal the longitudinal axis of drill bit head 88. A generally planar cutting member 108 is retained in a diametrically disposed slot 107 in distal end 104 of drill bit head 88 for bearing against the end of the bore hole during drilling to dislodge cuttings therefrom.

A primary water conduit 110 formed axially through shank 84 opens on the interior 112 of drill steel 82 as seen in FIG. 5. Two secondary water conduits 114, 116 formed in drill bit head 88 communicate at one end thereof with primary water conduit 110 and terminate at the other ends thereof in distinct water openings 118, 120, respectively, formed in lead surface 106 on opposite sides of cutting member 108 in close proximity to the leading edges 122, 124, respectively, thereof. Water openings 118, 120 are preferably in addition located radially proximate to the chisel edge 126 of cutting member 108, a well as axially proximate thereto.

In order to achieve a proper outflow of water introduced into the end of a bore hole through water openings 118, 120, the combined cross sectional areas of water openings 118, 120 should be substantially less than the cross-sectional area of the bore hole produced by drill bit 80 minus the largest cross-sectional area of drill bit head 80 taken in a plane normal the longitudinal axis thereof. In the embodiment shown in FIGS. 4 and 5 this would be at base 98.

The desired relationship between these cross-sectional areas can be achieved through the use of cylindrical sleeves 128, 130 having outer diameters substantially equal to the inner diameters of water openings 118, 120, respectively. Cylindrical sleeves 128, 130 may be pressed into water openings 118, 120, respectively, to reduce the effective cross-sectional areas thereof. In this manner a single drill bit, such as drill bit 80, can be adapted in terms of water flow quantity to meet the demands of any number of differing drilling conditions. The combined cross-sectional areas of the openings 132, 134 through cylindrical sleeves 128, 130, respectively, should be substantially less than the cross-sectional area of the bore hole cut by drill bit 80 minus the area of the largest cross-sectional area of drill bit head 88 taken in a plane normal the longitudinal axis thereof.

In another aspect of the present invention, means are provided for removably retaining drill bit 80 in drill steel 82 and permitting the rapid replacement of drill bit 80 by another in case of its failure. Shank 84 is provided with a radially disposed retention passageway 136 which communicates through shank 84 to primary water conduit 110. Drill steel 82 at socket 86 is provided with a similar retention passageway 138 of substantially identical cross-section. Retention passageway 138 communicates through the wall of drill steel 82 to socket 86. Retention passageways 136, 138 are alignable one with another when shank 84 of drill bit 80 is inserted into socket 86 of drill steel 82.

Figure 6:
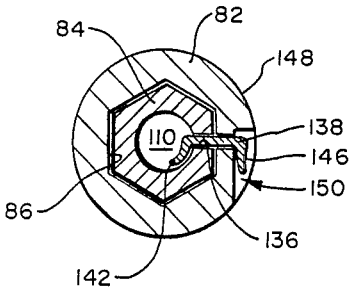
FIG. 6 is a cross-sectional plan view of the drill bit and drill steel shown in FIG. 4 taken along section line 6—6 appearing therein and illustrating an example of an embodiment of structure for retaining the drill bit in the drill steel.

When retention passageways 136, 138 are thus aligned drill bit 80 is retained in drill steel 82 by a selectively removable retention pin 140 that passes through both of retention passageways 136, 138 (see FIG. 6). While retention passageways 136, 138 and retention pin 140 are illustrated herein as essentially oval in cross-sectional shape, it will be readily appreciated that passageways 136, 138 and pin 140 may have any suitable shape.

Retention pin 140 is provided at one end thereof with a resilient arcuate tip 142 that resides within primary water conduit 110 when retention pin 140 is inserted through retention passageways 136, 138. Arcuate tip 142 is offset in alignment from the body 144 of retention pin 140 and is correspondingly out of alignment with retention passageways 136, 138 once retention pin 140 is inserted therethrough. Arcuate tip 142 thus secures retention pin 140 in retention passageways 136, 138, but due to resiliency provided in tip 142 it can be deformed into alignment with body 144 to permit removal of retention pin 140 and disassembly of drill bit 80 from drill steel 82.

At the opposite end of retention pin 140 from arcuate tip 142 is a head 146 which affords purchase of retention pin 140 from the outside of drill steel 82 and thus facilitates the extraction of retention pin 140 from retention passageways 136, 138. The outer wall 148 of drill steel 82 is provided at the opening of retention passageway 138 with a recess 150 in which head 146 of retention pin 140 rests when arcuate tip 142 of retention pin 140 is within primary water conduit 110. Head 146 is thus below the outside diameter of drill steel 82 and protected from wear during rotation of the assembly. By use of a flat tool, such as a screwdriver, inserted beneath head 146, retention pin 140 can easily be levered out of retention passageways 136, 138 to permit separation of drill bit 80 from drill steel 82. During removal of retention pin 140 in this fashion, resilient arcuate tip 142 is deformed into alignment with body 144 of retention pin 140. Insertion of retention pin 140 involves this process in reverse.

Figure 7:
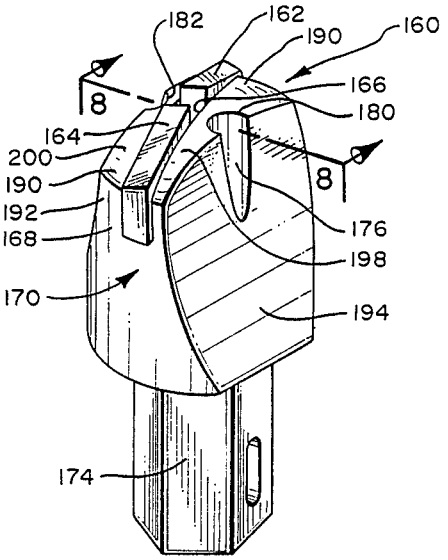
FIG. 7 is a perspective view of yet another embodiment of a drill bit incorporating teachings of the present invention.
Figure 8:
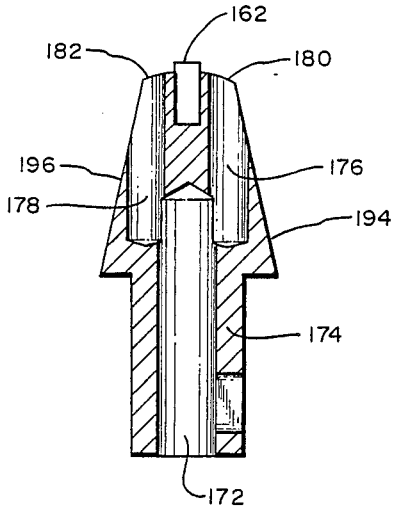
FIG. 8 is a cross-sectional elevation view of the drill bit shown in FIG. 7 taken along section line 8—8 appearing therein.

Yet another embodiment of a drill bit 160 according to the present invention is shown in FIGS. 7 and 8. In contrast to the embodiments of inventive drill bits illustrated and described earlier, drill bit 160 includes two separate planar cutting members 162, 164 mounted in planar alignment one with another in a diametrically disposed slot 166 in distal end 168 of drill bit head 170. Separate coplanar cutting members, such as cutting members 162, 164, function in substantially the same manner as a single planar cutting member, such as planar cutting member 108 of drill bit 80 and planar cutting member 24 of drill bit 10. Accordingly, as used herein, the term generally planar cutting member will include both a single planar cutting member and a plurality of cutting members mounted in coplanar relationship, such as cutting members 162, 164 shown in FIG. 7.

As best seen in FIG. 8, drill bit 160 is provided with a primary water conduit 172 axially formed through a shank 174 for opening on the interior of a drill steel. Secondary water conduits 176, 178 communicate at one end thereof with primary water conduit 172 and terminate at the other ends thereof in water openings 180, 182, respectively. Water openings 180, 182 are partially formed in lead surface 190 disposed generally normal the longitudinal axis of drill bit head 170 at the distal end 192 thereof and partially formed in slurry surfaces 194, 196, respectively, formed in the side of drill bit head 170 on opposite sides of the common plane of cutting members 162, 164. Such structure may be required when the inside diameter of water openings, such as water openings 180, 182, of a drill bit of the present invention are overly large in relation to the thickness of the portion of the triangular support shoulders, such as support shoulders 198, 200, in which such water openings are respectively located. Other aspects of drill bit 60 which do not differ significantly from the previous embodiments disclosed will not be described.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A mining drill bit for attachment to a hollow drill steel to rotate therewith and to cut a bore hole in rock or concrete, said drill bit comprising:

(a) a shank insertable in a socket in one end of the drill steel to permit said drill bit to be driven in rotation by the drill steel during drilling;

(b) a drill bit head having a distal end and a base at the end opposite therefrom, said drill bit head being rigidly attached at said base to said shank in axial alignment for rotation therewith;

(c) a generally planar cutting member retained in said distal end of said drill bit head for rotation therewith in alignment with the longitudinal axis thereof for bearing against the end of said bore hole during drilling to dislodge cuttings therefrom, said cutting member having a chisel edge traversing said cutting member between opposite faces thereof at the center of the portion of said cutting member that bears against the end of the bore hole during drilling, said chisel edge removing cuttings from the end of said bore hole to lead the cutting of same; and (d) irrigation means for injecting water into the end of said bore hole during drilling to remove cuttings from the vicinity of said rotating cutting member, said irrigation means comprising:

(i) a primary water conduit axially formed through said shank and opening on the interior of said drill steel; and (ii) at least one secondary water conduit formed in said drill bit head communicating at one end thereof with said primary water conduit and terminating at the other end thereof in a water opening in said distal end of said drill bit head, said water opening being located in radial proximity to said rotating cutting member with at least a portion of said water opening being adjacent a leading edge thereof.

2. A mining drill bit as recited in claim 1, wherein said water opening is located radially proximate to the chisel edge of said cutting member.

3. A mining drill bit as recited in claim 2, wherein said irrigation means comprises two secondary water conduits formed in said drill bit head, each of said secondary water conduits communicating at one end thereof with said primary water conduit and terminating at the other end thereof in distinct water openings in said distal end of said drill bit head on opposite sides of said cutting member.

4. A mining drill bit as recited in claim 3, wherein the combined cross-sectional areas of said water openings is substantially less than the cross-sectional area of said bore hole minus the largest cross-sectional area of said drill bit head taken in a plane normal the longitudinal axis thereof.

5. A mining drill bit as recited in claim 4, further comprising two cylindrical sleeves having outer diameters substantially equal to the inner diameters of said water openings for pressing thereinto to reduce the effective cross-sectional area of said water openings.

6. A mining drill bit as recited in claim 5, wherein the combined cross-sectional areas of the openings through said cylindrical sleeves is substantially less than the cross-sectional area of said bore hole minus the largest cross-sectional area of said drill bit head taken in a plane normal the longitudinal axis thereof.

7. A mining drill bit for attachment to a hollow drill steel to rotate therewith and to cut a bore hole in rock or concrete, said drill bit comprising:

(a) a shank insertable in a socket in one end of the drill steel to permit said drill bit to be driven in rotation by the drill steel during drilling;

(b) a drill bit head having a distal end and a base at the end opposite therefrom, said drill bit head being rigidly attached at said base to said shank in axial alignment for rotation therewith;

(c) a generally planar cutting member retained in said distal end of said drill bit head for rotation therewith in alignment with the longitudinal axis thereof for bearing against the end of said bore hole during drilling to dislodge cuttings therefrom, said cutting member having a chisel edge traversing said cutting member between opposite faces thereof at the center of the portion of said cutting member that bears against the end of the bore hole during drilling, said chisel edge removing cuttings from the end of said bore hole to lead the cutting of same;

(d) a primary water conduit axially formed through said shank and opening on the interior of said drill steel; and (e) two secondary water conduits formed in said drill bit head, each of said secondary water conduit communicating at one end thereof with said primary water conduit and terminating at the other end thereof in distinct water openings in said distal end of said drill bit head, said water openings being located on opposite sides of said rotating cutting member in radial proximity thereto with at least a portion of said water opening being adjacent to a leading edge thereof.

8. A mining drill bit as recited in claim 7, wherein said water opening is located axially proximate to the chisel edge of said cutting member.

9. A mining drill bit as recited in claim 8, wherein the combined cross-sectional areas of said water openings is substantially less than the cross-sectional area of said bore hole minus the largest cross-sectional area of said drill bit head taken in a plane normal the longitudinal axis thereof.

10. A mining drill bit as recited in claim 9, further comprising slurry means for scouring cuttings from the walls of said bore hole adjacent said head and for removing cuttings from the end of said bore hole.

11. A mining drill bit for attachment to a hollow drill steel to rotate therewith and to cut a bore hole in rock or concrete, said drill bit comprising:

(a) a shank insertable in a socket in one end of the drill steel to permit said drill bit to be driven in rotation by the drill steel during drilling;

(b) a drill bit head having a distal end and a base at the end opposite therefrom, said drill bit head being rigidly attached at said base to said shank in axial alignment for rotation therewith;

(c) a generally planar cutting member retained in said distal end of said drill bit head for rotation therewith in alignment with the longitudinal axis thereof for bearing against the end of said bore hole during drilling to dislodge cuttings therefrom, said cutting member having a chisel edge traversing said cutting member between opposite faces thereof at the center of the portion of said cutting member that bears against the end of the bore hole during drilling, said chisel edge removing cuttings from the end of said bore hole to lead the cutting of same;

(d) irrigation means for injecting water into the end of said bore hole during drilling to remove cuttings from the vicinity of said rotating cutting member, said irrigation means comprising:

(i) a primary water conduit axially formed through said shank and opening on the interior of said drill steel; and (ii) two secondary water conduits formed in said drill bit head, each of said secondary water conduits communicating at one end thereof with said primary water conduit and terminating at the other end thereof in distinct water openings in said distal end of said drill bit head, said water openings being located on opposite sides of said cutting member in radial proximity thereto with at least a portion of said water openings being adjacent a leading edge thereof; and (e) slurry means for scouring cuttings from the walls of said bore hole adjacent said drill bit head and for removing cuttings from the end of said bore hole.

12. A mining drill bit as recited in claim 11, wherein said slurry means comprises at least one slurry surface formed in the side of said drill bit head on one side of the plane of said cutting member, said slurry surface resulting in a longitudinally disposed slurry region of axial constriction of the periphery of said drill bit head extending from said distal end to said base thereof, whereby water injected into the end of said bore hole and cuttings removed from the vicinity of said cutting member encounter less resistance to flowing away from the end of said bore hole at said slurry region than at other points about the periphery of said drill bit head, said water and said cuttings thereby passing through said slurry region in a relatively rapidly moving outflow removing cuttings from the wall of the bore hole opposite said slurry region.

13. A mining drill bit as recited in claim 12, wherein the lateral cross-section of said slurry region diminishes from said distal end to said base of said drill bit head.

14. A mining drill bit as recited in claim 13, comprising two of said slurry regions located on diametrically opposite sides of said drill bit head.

15. A mining drill bit as recited in claim 14, wherein said distal end of said drill bit head between each of said slurry regions terminates in a lead surface disposed generally normal the longitudinal axis of said drill bit head, and wherein each of said water openings is at least partially formed in said lead surface.

16. A mining drill bit as recited in claim 15, and wherein each of said water opening sis formed in said lead surface.

17. A mining drill bit as recited in claim 16, wherein each of said water openings is located axially proximate to the chisel edge of said cutting member.

18. A mining drill bit as recited in claim 17, further comprising two cylindrical sleeves for pressing into said water openings to reduce the effective cross-sectional areas thereof.

19. A mining drill bit for attachment to a hollow drill steel to rotate therewith and to cut a bore hole in rock or concrete, said drill bit comprising:

(a) a shank insertable in a socket in one end of the drill steel;

(b) a generally cylindrical drill bit head having a distal end and a base at the end opposite therefrom, said drill bit head being rigidly attached at said base thereof to said shank in axial alignment therewith;

(c) a generally planar cutting member retained in said distal end of said drill bit head in alignment with the longitudinal axis thereof for bearing against the end of said bore hole during drilling to dislodge cuttings therefrom;

(d) slurry means for scouring cuttings from the walls of said bore hole adjacent said drill bit head and for removing cuttings from the end of said bore hole, said slurry means comprising two planar slurry surfaces formed in diametrically opposite sides of said drill bit head on opposite sides of the plane of said cutting member, said slurry surfaces being inclined relative the longitudinal axis of said drill bit head to be more remote radially from said axis of said drill bit head at the base thereof than at the distal end thereof, said slurry surfaces intersecting and truncating the circumferential periphery of said drill bit head at the base thereof to form chordal lips past which each of said slurry surfaces and the wall of said bore hole opposite respectively thereto funnel water injected into the end of said bore hole and cuttings removed from the vicinity of said cutting member, said distal end of said drill bit head between said slurry surfaces terminating a in a lead surface disposed generally normal the longitudinal axis of said drill bit head; and (e) irrigation means for injecting water into the end of said bore hole during drilling to remove cuttings from the vicinity of said cutting member, said irrigation means comprising:

(i) a primary water conduit axially formed through said shank and opening on the interior of said drill steel; and (ii) two secondary water conduits formed in said drill bit head, each of said secondary water conduits communicating at one end thereof with said primary conduit and terminating at the other end thereof in distinct water openings at least partly formed in said lead surface on opposite sides of said cutting member in radial proximity thereto with at least a portion of said water openings being adjacent a leading edge thereof.

20. A mining drill bit as recited in claim 19, wherein each of said water openings is located radially proximate to the chisel edge of said cutting member.

21. A mining drill bit as recited in claim 20, wherein each of said water openings is located axially proximate to the chisel edge of said cutting member.

22. A mining drill bit as recited in claim 19, wherein said water openings are formed in said lead surface of said cutting member.

23. A mining drill bit as recited in claim 22, further comprising two cylindrical sleeves for pressing into said water openings to reduce the effective cross-sectional area thereof.

24. A mining drill bit for attachment to a hollow drill steel to rotate therewith and to cut a bore hole in rock or concrete, said drill bit comprising:

(a) a shank insertable in a socket in one end of the drill steel;

(b) a generally cylindrical drill bit head having a distal end and a base at the end opposite therefrom, said drill bit head being rigidly attached at said base to said shank in axial alignment therewith;

(c) two planar slurry surfaces formed on diametrically opposite sides of said drill bit head, said slurry surfaces defining therebetween at the distal end of said drill bit head a diametrically disposed wedge-shaped lead portion, said slurry surfaces at the wide end of said lead portion intersecting and truncating the circumferential periphery of said drill bit head at the base thereof to form chordal lips;

(d) a diametrical slot formed in said lead portion of said drill bit head adopted to receive and to retain therein alignment with the longitudinal axis of said drill bit head a generally planar cutting member for bearing against the end of said bore hole during drilling to dislodge cuttings therefrom;

(e) a primary water conduit axially formed through said shank and opening on the interior of said drill steel; and (f) two secondary water conduits formed in said drill bit head, each of said second water conduits communicating at one end thereof with said primary water conduit and terminating at the other end thereof in two distinct water openings formed in respective ones of said cutting member support shoulders on opposite sides of said diametrical slot in radial proximity thereto with at least a portion of said water openings being adjacent a leading edge of said cutting member when said cutting member is retained in said diametrical slot, so as to direct water introduced under pressure into the interior of the drill steel against the end of said bore hole in close proximity to the leading edges of said cutting member during drilling.

25. A mining drill bit as recited in claim 24, wherein said diametrical slot intersects the circumferential periphery of said drill bit head at said lead portion thereof between said slurry surfaces.

26. A mining drill bit as recited in claim 25, wherein said diametrical slot separates said lead portion of said drill bit head into two upstanding generally triangular cutting member support shoulders extending between diametrically opposite sides of said drill bit head, said cutting member support shoulders supporting opposite faces of said cutting member transverse the diameter of said drill bit head when said cutting member is received in said diametrical slot.

27. A mining drill bit as recited in claim 26, wherein the thickness of each of said support shoulders measured normal the face of said cutting member adjacent thereto is less adjacent the lead edge side of said face of said cutting member than adjacent the trailing edge side thereof.

28. A mining drill bit as recited in claim 27, wherein said thickness of each of said support shoulders is a linear function of the distance along said cutting member from the radially outermost end of the lead edge side of the face of said cutting member adjacent thereto.

29. A mining drill bit as recited in claim 28, further comprising two cylindrical sleeves for pressing into said water openings to reduce the effective cross-sectional area thereof.

30. A mining drill bit as recited in claim 24, wherein said shank is hexagonal in cross-section.

31. A mining drill bit as recited in claim 30, wherein the plane of said diametrical slot is aligned with diametrically opposite vertices of the hexagonal cross-section of said shank.

32. A mining drill bit as recited in claim 24, wherein said shank and said drill steel are each provided with a radially disposed retention passageway, said retention passageway in said shank communicating through said shank with said primary water conduit and said retention passageway in said drill steel communicating through said drill steel at said socket therein to the interior of said drill steel, said retention passageways being alignable one with another by inserting said shank into said socket in said drill steel.

33. A mining drill bit as recited in claim 32, further comprising a selectively removable retention pin having a resilient arcuate tip for insertion first through said retention passageway in said drill steel and then through said retention passageway in said shank when said retention passageways are aligned such that said arcuate tip comes to reside within said primary water conduit out of alignment with said retention passageways, thereby securing said retention pin in said retention passageways and retaining said shank of said drill bit in said drill steel.

34. A mining drill bit as recited in claim 33, wherein said retention pin is provided at the end opposite said arcuate tip thereof with a head for facilitating the selective removal of said retention pin from said retention passageways to permit separation of said shank and said drill steel.

35. A mining drill bit as recited in claim 34, wherein the outer wall of said drill steel at the opening of said retention passageway therein is provided with a recess and said head of said retention pin rests within said recess when said arcuate tip of said retention pin is within said primary water conduit.

36. A mining drill bit as recited in claim 24, further including a generally planar cutting member retained in said diametrical slot in said drill bit head.

37. A mining drill bit for attachment to a hollow drill steel to rotate therewith and to cut a bore hole in rock or concrete, said drill bit comprising:

(a) a shank of hexagonal cross-section for insertion into a correspondingly shaped socket in one end of said drill steel;

(b) a generally cylindrical drill bit head having a distal end and a base at the end opposite therefrom, said drill bit head being rigidly attached at the base thereof to said shank in axial alignment therewith;

(c) a generally planar cutting member retained in said distal end of said drill bit head in alignment with the longitudinal axis of said drill bit head and with diametrically opposite vertices of said shank for bearing against the end of said bore hole during drilling to dislodge cuttings therefrom;

(d) a primary water conduit axially formed through said shank and opening on the interior of said drill steel;

(e) two secondary water conduits formed in said drill bit head, each of said secondary water conduits communicating at one end thereof with said primary water conduit and terminating at the other end thereof in distinct water openings in said distal end of said drill bit head, said water openings being located on opposite sides of said cutting member in close proximity to individual leading edges thereof and in radial and axial proximity to the chisel edge thereof, whereby water introduced under pressure into the interior of said drill steel passes through said primary water conduit, said secondary water conduits, and said water openings for injection into the end of said bore hole in close proximity to the leading edges of said cutting member during drilling; and (f) slurry means for scouring cuttings from the walls of said bore hole adjacent said drill bit head and for removing cuttings from the end of said bore hole, said slurry means comprising two planar slurry surfaces formed in diametrically opposite sides of said drill bit head on opposite sides of the plane of said cutting member, said slurry surfaces being inclined relative the longitudinal axes of said drill bit head to be more remote radially from said axis of said drill bit head at the base thereof than at the distal end thereof, said planar surfaces intersecting and truncating the circumferential periphery of said drill bit head at said base thereof to form chordal lips past which each of said slurry surfaces and the wall of the bore hole opposite respectively thereto funnel water injected into the end of said bore hole and cuttings removed from the vicinity of said cutting member.

38. An attachment system for securing a mining drill bit to a hollow drill steel for cutting a bore hole in rock or concrete, the drill bit having a shank insertable in a socket portion in one end of the drill steel and a primary water conduit axially formed through the shank and opening on the interior of the drill steel, said attachment system comprising:

a. a first radially disposed retention passageway formed in the shank communicating therethrough with the primary water conduit;

b. a second radially disposed retention passageway formed in the socket portion of the drill steel and communicating through the drill steel to the interior thereof, said first and second passageways being alignable one with another by inserting the shank into the socket portion of the drill steel;

c. a selectively removable retention pin having a resilient arcuate tip for insertion first through said second retention passageway and then through said first retention passageway when said first and second retention passageways are aligned, such that said arcuate tip comes to reside within the primary water conduit out of alignment with said first and second retention passageways, thereby securing said retention point in said retention passageways and retaining the shank of the drill bit in the drill steel.

39. An attachment system as recited in claim 38, wherein said retention pin is provided at the end opposite said arcuate tip thereof with a head for facilitating the selective removal of said retention pin from said retention passageways to permit separation of the shank and the drill steel.

40. An attachment system as recited in claim 39, further comprising a recess in the outer wall of the drill steel at the opening of said second retention passageway therein, said head of said retention pin resting within said recess when said arcuate tip of said retention pin comes to reside within the primary water conduit.

41. A mining drill bit for attachment to a hollow drill steel to rotate therewith and to cut a bore hole in rock or concrete, said drill bit comprising:

(a) a shank insertable in a socket in one end of the drill steel;

(b) a generally cylindrical drill bit head having a distal end and a base at the end opposite therefrom, said drill bit head being rigidly attached at said base thereof to said shank in axial alignment therewith;

(c) a generally planar cutting member retained in said distal end of said drill bit head in alignment with the longitudinal axis thereof for bearing against the end of said bore hole during drilling to dislodge cuttings therefrom;

(d) irrigation means for injecting water into the end of said bore hole during drilling to remove cuttings from the vicinity of said cutting member;

(e) slurry means for scouring cuttings from the walls of said bore hole adjacent said drill bit head and for removing cuttings from the end of said bore hole, said slurry means comprising two planar slurry surfaces formed in diametrically opposite sides of said drill bit head on opposite sides of the plane of said cutting member, said slurry surfaces being inclined relative the longitudinal axis of said drill bit head to be more remote radially from said axis of said drill bit head at the base thereof than at the distal end thereof, each of said slurry surfaces and the wall of said bore hole opposite respectively thereto funneling water injected into the end of said bore hole and cuttings removed from the vicinity of said cutting member toward said base of said drill bit head;

(f) a primary water conduit axially formed through said shank and opening on the interior of said drill steel; and (g) two secondary water conduits formed in said drill bit head, each of said secondary water conduits communicating at one end thereof with said primary water conduit and terminating at the other end thereof in distinct water openings in said distal end of said drill bit head, said water openings being located on opposite sides of said cutting member in radial proximity thereto with at least a portion of said water openings being adjacent a leading edge thereof.

42. A mining drill bit as recited in claim 41, wherein said slurry surfaces intersect and truncate the circumferential periphery of said drill bit head at the base thereof to form chordal lips past which each of said slurry surfaces and the wall of said bore hole opposite respectively thereto funnel water injected into the end of said bore hole and cuttings removed from the vicinity of said cutting member.

* * * * *